US006209496B1

(12) United States Patent
Pelz

(10) Patent No.: US 6,209,496 B1
(45) Date of Patent: Apr. 3, 2001

(54) RECIPROCATING INTERNAL COMBUSTION ENGINE

(76) Inventor: Peter Pelz, Daimlerweg 2, D-82538, Geretsried (DE)

( * ) Notice: Subject to any disclaimer, the term of this patent is extended or adjusted under 35 U.S.C. 154(b) by 0 days.

(21) Appl. No.: 09/285,598

(22) Filed: Apr. 2, 1999

(30) Foreign Application Priority Data

Apr. 2, 1998 (DE) ..... 198 14 870

(51) Int. Cl.[7] ..... F02B 75/32
(52) U.S. Cl. ..... 123/59.6; 123/197.3; 123/197.4
(58) Field of Search ..... 123/59.6, 197.3, 123/197.4

(56) References Cited

U.S. PATENT DOCUMENTS

| | | | | |
|---|---|---|---|---|
| 2,392,921 | | 1/1946 | Holman . | |
| 4,505,239 | * | 3/1985 | Deland | 123/197.3 |
| 4,690,113 | * | 9/1987 | Deland | 123/197.3 |
| 5,595,147 | * | 1/1997 | Feuling | 123/59.6 |
| 5,682,844 | * | 11/1997 | Wittner | 123/197.3 |
| 5,873,333 | * | 2/1999 | Wittner | 123/197.4 |

FOREIGN PATENT DOCUMENTS

| | | |
|---|---|---|
| 32 38 030 | 4/1983 | (DE) . |
| 8902028 | 3/1989 | (GB) . |

* cited by examiner

*Primary Examiner*—Marguerite McMahon
(74) *Attorney, Agent, or Firm*—Robert W. Becker & Associates

(57) ABSTRACT

A reciprocating internal combustion engine has at least one cylinder with a reciprocating piston arranged therein. Two parallel crankshafts connected by a toothing rotate in opposite direction. Each one of the pistons has first and second rigid connecting rods, wherein the first connecting rod is connected to the first crankshaft and the second connecting rod is connected to the second crankshaft. Various connecting rod arrangements are possible. In one embodiment, the connecting rods are curved toward one another and toward a center axis of the cylinder. The piston may have two connecting rod bearings spaced apart in the direction in the spacing between the crankshafts. The first connecting rod connected to the first crankshaft may be connected to a connecting rod bearing that is remote from the crankshaft, and the second connecting rod connected to the second crankshaft may be connect to the other connecting rod bearing remote from the second crankshaft. The shape of the piston may vary, for example, a disc-shaped piston bottom with a central bottom projection is provided. The projection has an end portion to which the connecting rods are connected, and a constriction is provided between the bottom and end portion. In an another design a piston with curved cross-section having a concave top side and convex bottom side is provided. The concave top side faces the combustion chamber, and the convex bottom side has the connecting rods connected thereto.

4 Claims, 5 Drawing Sheets

RECIPROCATING INTERNAL COMBUSTION ENGINE

BACKGROUND OF THE INVENTION

The present invention relates to a reciprocating combustion engine comprising at least one cylinder in which a piston is reciprocatingly moveable and is connected by connecting rods to two parallel crank shafts that are connected by a toothing to one another such that they rotate in opposite directions.

Such a reciprocating internal combustion engine is known from German Patent Application 32 38 030 A1 and is described in the following with the aid of FIG. 8. The reciprocating internal combustion engine is shown in an exemplary fashion as a spark ignition engine (otto engine) and has a cylinder 2 in which a piston 4 is working. The intake manifold 6 opens into the cylinder head 8 whereby in the mouth of the intake manifold at the cylinder head an intake valve 10 is provided. Furthermore, an exhaust manifold 12 is represented having a mouth at the cylinder head 8 in which the exhaust valve 14 is positioned.

In the intake manifold a throttle 16 is positioned, and downstream of the throttle 16 the fuel injector 18 is positioned. In the cylinder head spark plugs 20 are also positioned which extend into the combustion chamber.

A control device 22 is provided for controlling the spark plugs 20 and the fuel injector 18 whereby the input terminals of the control device are supplied in a manner known to a person skilled in the art by signals of different sensors for detecting the operating parameters of the internal combustion engine. The control device 22 then computes control signals for controlling injection and ignition.

In the crankcase 28 of the internal combustion engine two parallel crankshafts 30 and 32 are arranged which, relative to the axis of piston movement, are symmetrically arranged and are connected to one another by a meshing toothing (gear wheel) 34 so that they rotate in opposite directions.

Each one of the crankshafts 30 and 32 is connected by a connecting rod 36, 38 to the piston 4. The underside of the piston has spaced apart bearings 40 and 42 for supporting the connecting rods 36 and 38, whereby the bearings 40 and 42 are spaced in the direction of spacing between the crankshafts 30 and 32. As an alternative, the connecting rods can also be coaxially connected to the piston.

A special feature of the double crankshaft drive will be explained with the aid of FIG. 9. The ordinate of the diagram shows the piston stroke H and the abscissa shows the angle of rotation of the crankshafts, relative to the bottom dead center UT of the piston. This means that between the two bottom that center positions a 360° rotation of the crankshaft takes place.

The dashed line shows the behavior of a conventional crankshaft drive in which the crankshaft is arranged centrally below the piston. The top dead center $OT_1$ of the piston in the conventional crankshaft drive is located exactly between the two bottom UT positions, i.e., at 180° angle of rotation of the crankshaft.

For the double crankshaft drive according to FIG. 8, in which the two crankshafts 30 and 32 are symmetrically offset relative to the center of the piston 4, a curve shown in solid lines results. Starting from the UT position of the piston the crankshafts 30 and 32 rotate in opposite directions whereby the left crankshaft of FIG. 1 rotates in the clockwise direction by less that 180° until the top dead center $OT_2$ of the piston has been reached and, subsequently, upon rotation by more than 180°, will reach again the bottom dead center UT. In a four stroke method, the intake stroke and the working stroke, in comparison to conventional crankshaft drive have available, an increased angular range and thus a longer time period so that filling and load conversion are improved.

One special feature of the double crankshaft drive is that the connecting rods 36 and 38 are rotated outwardly from the axis of the piston. The wall of the cylinder 2 can thus be elongated in the direction toward the crankshaft drive only to a limited amount. This accordingly limits the stroke length that can be realized for the provided constructive space and thus determines the constructive height of the engine.

It is an object of the present invention to embody a reciprocating internal combustion engine of the aforementioned kind such that for a given constructive height an increased stroke is realized.

SUMMARY OF THE INVENTION

According to a first solution, the connecting rods are curved toward the cylinder axis.

In a preferred embodiment, the connecting eyes for the connecting rods are spaced at the piston in the direction of spacing of the crankshafts. The facing sides of the connecting rods are slanted such the connecting rods can move relative to one another with overlap.

In another solution of the inventive object, the piston is provided with two connecting rod bearings which are spaced in the direction of spacing between the crankshafts, and each connecting rod is respectively connected to the connecting rod bearing remote from the respective crankshaft to which the connecting rod is fastened.

In yet another embodiment of the invention, the piston is provided with a substantially disc-shaped piston bottom having a central area with a projection having an end portion for receiving the connecting rods whereby between the piston bottom and the end portion a constriction is provided.

In yet another embodiment of the invention the piston is in cross-section of a curved shape whereby the concave side faces the combustion chamber and the convex side is designed for receiving the connecting rods.

The inventive solutions presented above are especially useful when the ratio of connecting rod length to crankshaft spacing to crankshaft stroke is 2.2–1.8 to 1.85–1.55 to 1.1–0.9.

The invention thus provides a reciprocating internal combustion engine that, in comparison to conventional reciprocating combustion engines having only a single crankshaft, has a higher rpm level and thus an increased output. Relative to its output the inventive engine has a reduced weight and is of a small size. The invention allows, in particular, to embody reciprocating internal combustion engines to have a minimal constructive height for a given displacement.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENTS

The present invention will now be described in detail with the aid of several specific embodiments utilizing FIGS. 1 through 9.

Figure 1:
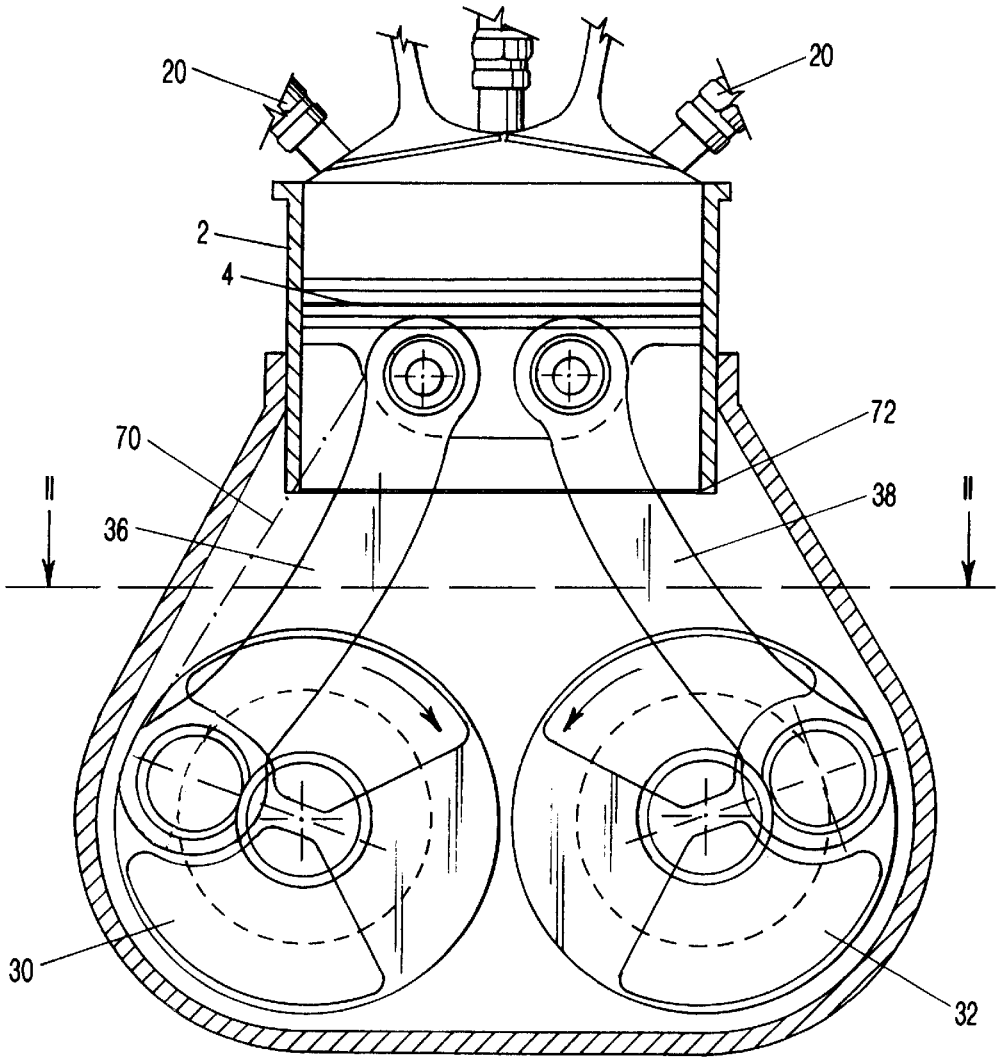
FIG. 1 shows a cross-section of a reciprocating internal combustion engine.
Figure 8:
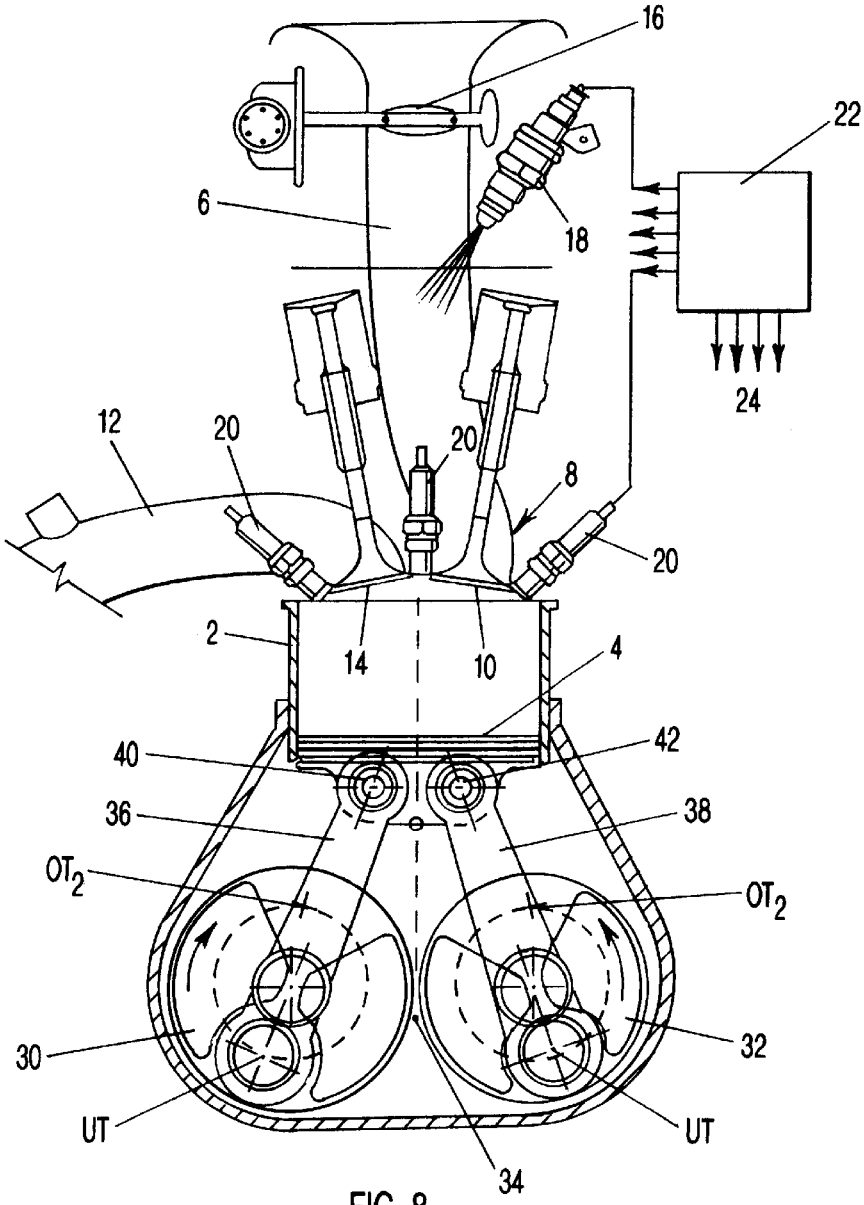
FIG. 8 shows a cross-section of a reciprocating combustion engine of the prior art.
Figure 9:
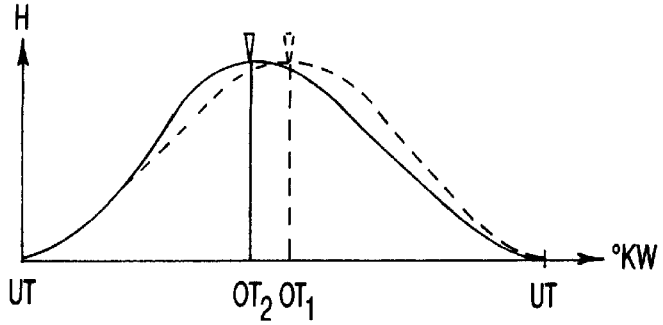
FIG. 9 shows a diagram for illustrating the function of the double crankshaft drive.

FIG. 1 employs the same reference numerals as FIG. 8. The difference with respect to FIG. 8 is that the crankshafts 30 and 32 are in a position in which the connecting rods 36 and 38 are positioned as far apart as possible and that the connecting rods are not of a straight design but are curved toward the longitudinal center plane of the engine, respectively, the axis of the cylinder.

The contour of the connecting rod 36 in the left half of the drawing is indicated for a straight embodiment in a dash-dotted line and indicated by reference numeral 70. As can be seen, the connecting rods 36 and 38 for a straight design would contact the lower end 72 of the cylinder so that the stroke realized in FIG. 1 would not be possible with this embodiment. The inwardly curved embodiment of the connecting rod 36 and 38 and thus the provided concave embodiment of its outer sides provides a free space between the lower area 72 of the cylinder 2 and the connecting rods 36 and 38 while otherwise the design of the crankshaft drive (spacing between the axis of the crankshafts 30 and 32 as well as spacing of the connecting rod bearings at the crankshaft from the crankshaft axis) is identical.

Figure 2:
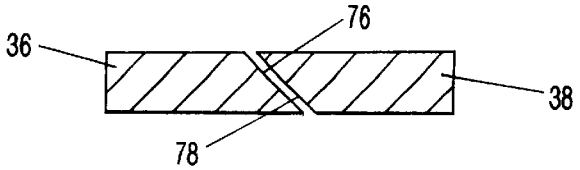
FIG. 2 shows a detail sectional view of the connecting rods of FIG. 1, showing a section in the plane II—II for a rotational position of the crankshafts that differs from that in the representation of FIG. 1.

FIG. 2 shows a section of the connecting rods 36 and 38 in the position of the crankshafts 30 and 32 in which the respective connecting rod bearings are in the closest possible position. Due to their curvature, the inner sides of the connecting rods 36 and 38 in this position would contact one another which would limit the amount of curvature or would require an increase of the spacing between the crankshafts or would result in a reduction of the stroke. In order to prevent this, the inner surfaces of the connecting rods 36 and 38 are either conically embodied or provided with slanted surfaces 76 and 78 so that the connecting rods, in the view of FIG. 1, can move past one another by overlapping in the area of the slanted surfaces.

Figure 3:
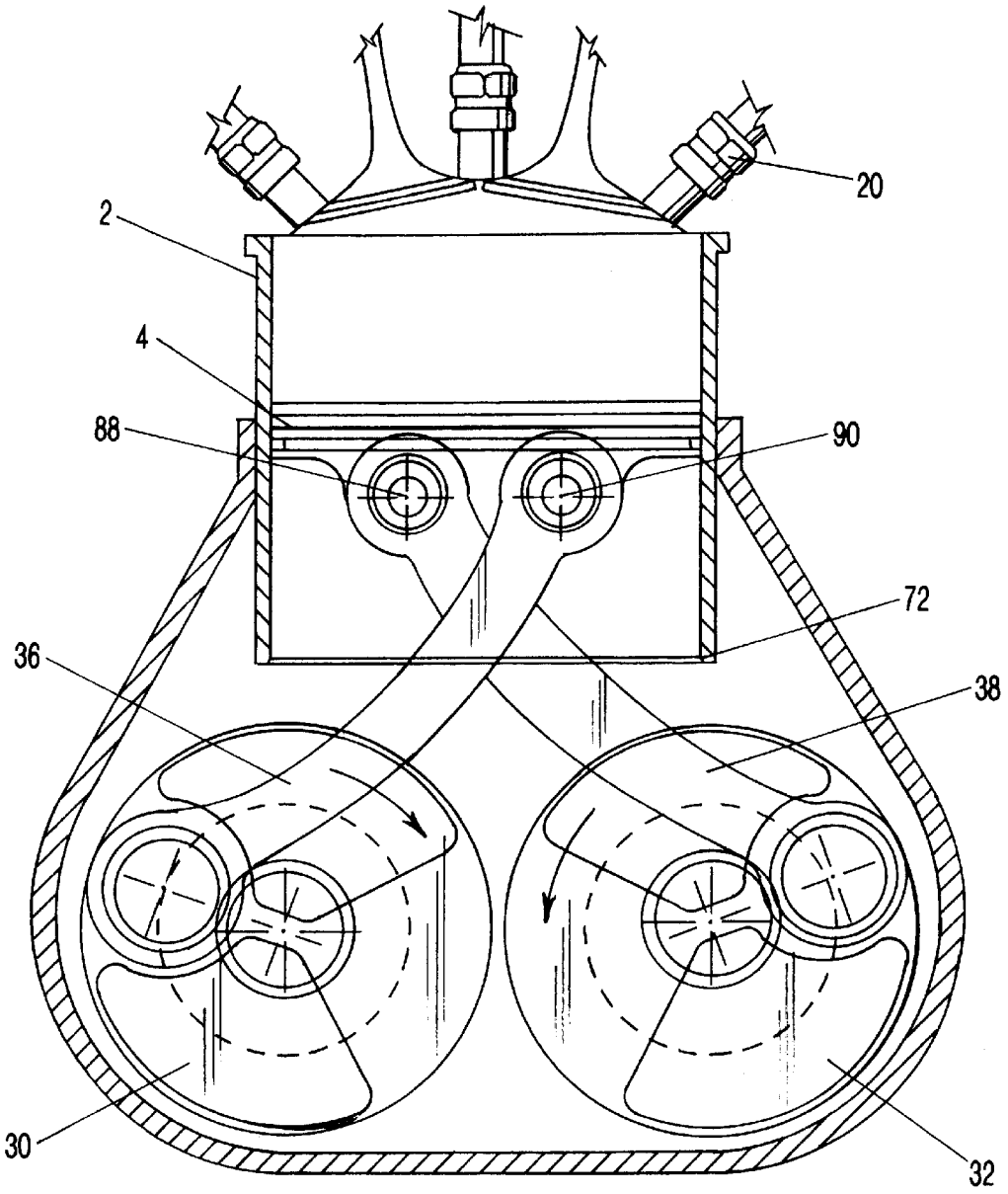
FIG. 3 shows a cross-section of a further embodiment of a reciprocating internal combustion engine.

The embodiment of the crankshaft drive according to FIG. 3 differs from that of FIG. 1 in that, according to FIG. 3, the left connecting eye 88 serves for supporting the connecting rod 38 connected to the crankshaft 32 at the right side of FIG. 3 and that the right connecting eye 90 of the piston 4 serves to support the connecting rod 36 connected to the left crankshaft 30. As can be seen in FIG. 3, in this manner the cylinder 2 can be extended to a much greater extent in the direction toward the crankshafts without resulting in impaired movement of the connecting rods 36 and 38. As can be further seen in FIG. 3, in this embodiment the connecting rods 36 and 38 are at least partially in different planes so that the partially overlapping movement shown in FIG. 3 is possible. In a variant of this embodiment, the connecting rods 36 and 38 could be of a straight design.

Figure 4:
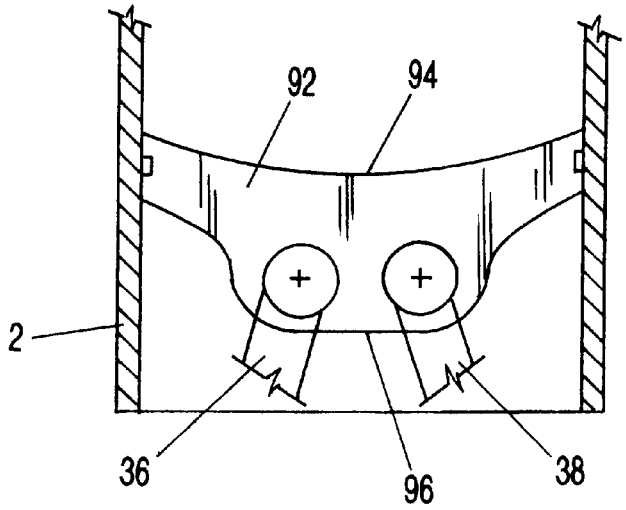
FIG. 4 shows a cross-section of a piston.

FIG. 4 shows yet another embodiment that differs from the previously described embodiments. Its piston 92 is in cross-section substantially banana-shaped whereby its concave top side 94 delimits the combustion chamber (not represented) and the convex bottom side has an end portion 96 to which the connecting rods 36 and 38 are connected. In this embodiment of the piston not only the flow behavior within the combustion engine is advantageously improved; also, the bearings of the connecting rods 36 and 38 are displaced relative to the combustion chamber farther downwardly so that relative to the predetermined (given) lower end of the cylinder 2 an increased stroke is possible.

Figure 5:
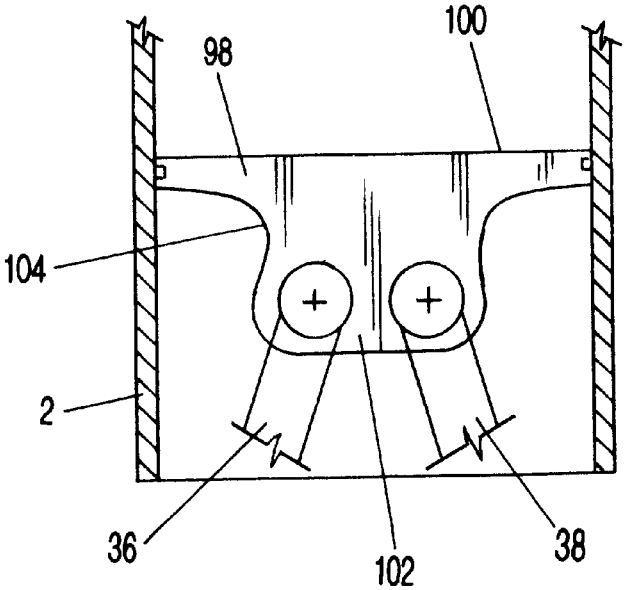
FIG. 5 shows a cross-section of another shape of the piston.

A further embodiment of a piston 98 is shown in FIG. 5. The piston of this embodiment has a substantially disc-shaped piston bottom 100 which has at is central area a projection 102 to which the connecting rods 36 and 38 are connected. The projection 102 has preferably a constriction 104 for weight reduction of the piston 98. In this embodiment of the piston 98 the connecting rods 36 and 38 are spaced farther from the combustion chamber so that the stroke that can be realized is increased.

All of the disclosed pistons have in common that because of the missing sleeve they are of a light-weight design in comparison to conventional pistons, whereby this advantage is most important in connection with pistons according to FIGS. 1 and 3.

It is understood that the disclosed embodiments of the connecting rods and their connection to the piston as well as the piston itself can be combined with one another. Furthermore, the bearings of the connecting rods at the piston must not be radially spaced from one another but can also be coaxial.

The toothing (gear wheel) between the crankshafts must not be necessarily provided at its ends. It is also possible that the crank discs that support the connecting rod bearings and/or the compensation discs have a toothing at their outer circumference and mesh with one another. The power (output) generated by the engine can be transmitted by one of these toothings whereby a plurality of output shafts, for example, one connected to the transmission (gear box) and another connected to auxiliary devices, can be provided.

Figure 6:
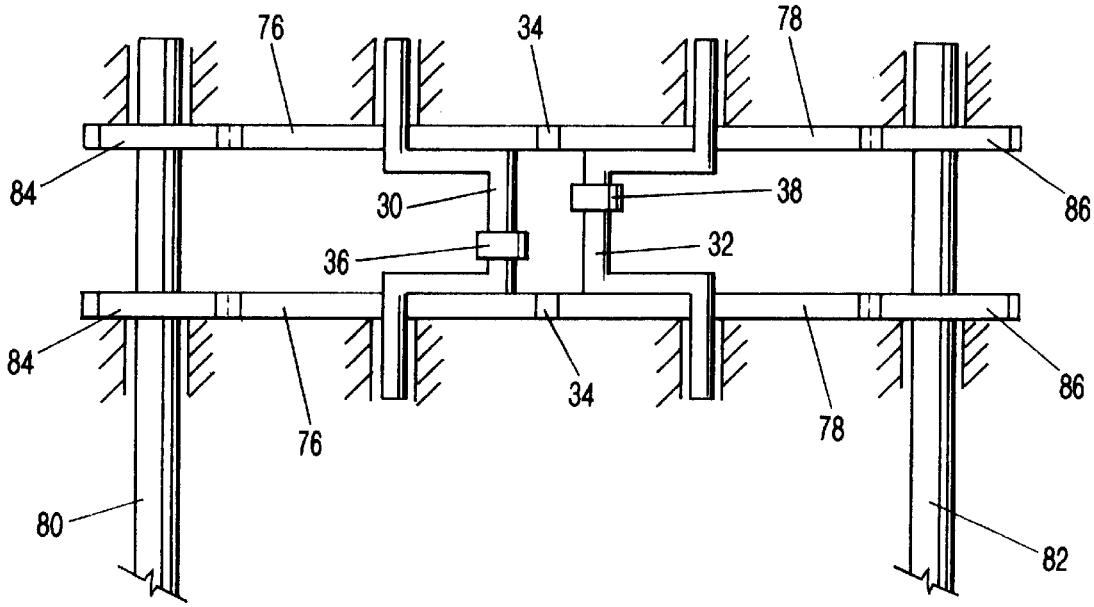
FIG. 6 shows a plan view onto the crankshaft drive on an internal combustion engine.

FIG. 6 shows a view of two crankshafts 30 and 32 as they are provided, for example, in connection with an engine according to FIG. 3. Schematically represented is the displaced connection of the connecting rods 36 and 38. To each one of the crankshafts toothed compensation discs 76 and 78 are fastened which compensate the imbalance of the crankshafts. The compensation discs 76 and 78 are provided at their outer circumference with toothings which mesh with one another at 34. In this manner, a safe and play-free toothing between the crankshafts 30 and 32 is realized.

Depending on the application, the output can be transmitted from the crankshaft drive axially via one of the crankshafts or via both of the crankshafts and/or via one or more of the compensation discs 76 and 78. In the shown embodiment, the output shafts 80 and 82 are rigidly connected to the toothed discs (gears) 84 and 86 which mesh with the compensation discs 76 and 78. The arrangement according to FIG. 6 is suitable, for example, for driving a ship provided with two propellers. The propellers will rotate in opposite directions so that the ship can be steered especially easily.

Figure 7:
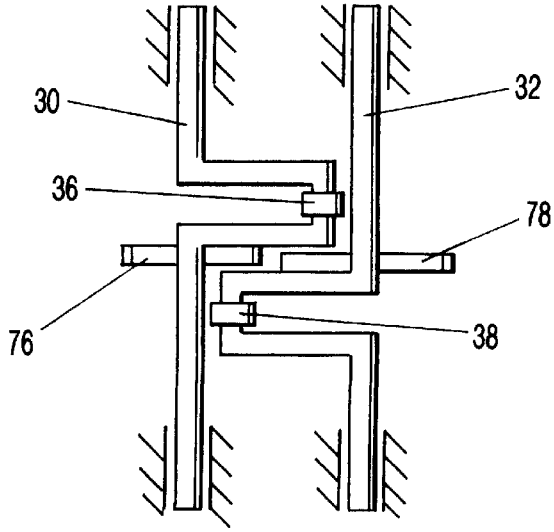
FIG. 7 shows a plan view onto another embodiment of the piston drive.

The embodiment according to FIG. 7 differs from the one in FIG. 6 in that the spacing between the axes of the crankshafts 30 and 32 is smaller than twice the crank length so that the described crank circles in an end view will intercept one another. The crankshaft portions to which the connecting rods 36 and 38 are connected are accordingly axially shorter and positioned adjacent to one another, whereby the compensation discs 76 and 78 have a substantially smaller diameter than shown in FIG. 6.

It is understood that the inventive double crankshaft motor is not limited to embodiments with two cylinders. It is possible to arrange a plurality of two cylinder motors in a row behind one another or to provide the crankshafts of one motor with a plurality of crank portions for attaching connecting rods.

In practice, a crankshaft drive for auto engines with the following dimensions has been proven especially successful:

connecting rod length 160 mm, crankshaft spacing 135 mm, crank stroke 79 mm.

In practice, it is favorable to employ the following ratios:

Connecting rod length (spacing between the bearing axis of a connecting rod) to spacing between crankshafts (spacing between axis of the crankshafts) to crank stroke (spacing between the connecting rod bearing and the crankshaft axis).

2.2–1.8 to 1.85–1.55 to 1.1–0.9.

For diesel engines, the ratio of the crankshaft spacing to connecting rod length is advantageously approximately 1 to 1.3.

For special applications, and when it is advantageous in practice, for example, when using especially fast burning fuels or for pumps, it may be expedient to operate the crank drive with a direction of rotation opposite to the one shown in FIG. 1

The specification incorporates by reference the disclosure of German priority document 198 14 870.4 of Apr. 2, 1998.

The present invention is, of course, in no way restricted to the specific disclosure of the specification and drawings, but also encompasses any modifications within the scope of the appended claims.

What is claimed is:

1. A reciprocating internal combustion engine comprising:

at least one cylinder (2) having a reciprocating piston (98) arranged therein;

two parallel crankshafts (30, 32) connected by a toothing (34) and rotating in opposite directions;

a first connecting rod (36) and a second connecting rod (38) connecting said at least one piston (4) to said crankshafts (30, 32);

wherein said first connecting rod (36) is connected to a first one of said crankshafts (30, 32) and a second connecting rod (38) is connected to a second one of said crankshafts (30, 32)

wherein said piston (98) has a disc-shaped piston bottom (100) having a projection (102) at a center of said bottom (100), wherein said projection (102) has an end portion for receiving said connecting rods (36, 38) and wherein said projection (102) has a constriction (104) located between said bottom (100) and said end portion.

2. An engine according to claim 1, wherein a length of said connecting rods (36, 38) to a spacing between said crankshafts (30, 32) to the crankshaft stroke is 2.2–1.8 to 1.85–1.55 to 1.1–0.9.

3. A reciprocating internal combustion engine comprising:

at least one cylinder (2) having a reciprocating piston (92) arranged therein;

two parallel crankshafts (30, 32) connected by a toothing (34) and rotating in opposite directions;

a first connecting rod (36) and a second connecting rod (38) connecting said at least one piston (4) to said crankshafts (30, 32);

wherein said first connecting rod (36) is connected to a first one of said crankshafts (30, 32) and a second connecting rod (38) is connected to a second one of said crankshafts (30, 32);

wherein said piston (92) has a curved cross-section having a concave top side (94) and a convex bottom side, wherein said concave top side (94) faces a combustion chamber of said cylinder and wherein said convex bottom side (96) has said connecting rods (36, 38) connected thereto.

4. An engine according to claim 3, wherein a length of said connecting rods (36, 38) to said spacing between said crankshafts (30, 32) to the crankshaft stroke is 2.2–1.8 to 1.85–1.55 to 1.1–0.9.

* * * * *